US006687477B2

(12) United States Patent
Ichida et al.

(10) Patent No.: US 6,687,477 B2
(45) Date of Patent: Feb. 3, 2004

(54) TONER RECYCLE CONTROL SYSTEM OF ELECTROPHOTOGRAPHING DEVICE USING VISCOUS LIQUID DEVELOPING SOLUTION

(75) Inventors: Motoharu Ichida, Tsubata-machi (JP); Satoshii Moriguchi, Kanazawa (JP); Shigeki Uesugi, Unoke-machi (JP); Yoshiaki Kawamoto, Kanazawa (JP); Seiichi Takeda, Kanazawa (JP); Tadasuke Yoshida, Uchinada-machi (JP); Yoshiaki Fujimoto, Kanazawa (JP); Jiyun Du, Kanazawa (JP); Masanobu Hongo, Unoke-machi (JP); Yasuhiko Kishimoto, Uchinada-machi (JP); Hitoshi Terashima, Kanazawa (JP); Satoru Moto, Kanazawa (JP); Masanari Takabatake, Kanazawa (JP); Hideaki Shibata, Kanazawa (JP); Tatsuo Nozaki, Unoke-machi (JP); Yutaka Nakashima, Kanazawa (JP); Tadashi Nishikawa, Tsubata-machi (JP); Akihiko Inamoto, Uchinada-machi (JP); Satoshi Miyamoto, Hakui (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 10/344,662

(22) PCT Filed: Mar. 29, 2002

(86) PCT No.: PCT/JP02/03144

§ 371 (c)(1),
(2), (4) Date: Feb. 14, 2003

(87) PCT Pub. No.: WO02/093269

PCT Pub. Date: Nov. 21, 2002

(65) Prior Publication Data

US 2003/0175049 A1 Sep. 18, 2003

(30) Foreign Application Priority Data

May 11, 2001 (JP) ..... 2001-141143
Dec. 4, 2001 (JP) ..... 2001-369862
Dec. 7, 2001 (JP) ..... 2001-373762

(51) Int. Cl.[7] ..... G03G 15/10

(52) U.S. Cl. ..... 399/237; 399/57; 399/58; 399/238; 399/247

(58) Field of Search ..... 399/57, 58, 237, 399/238, 246, 247

(56) References Cited

U.S. PATENT DOCUMENTS 5,983,047 A * 11/1999 Lee ..... 399/57
6,011,943 A * 1/2000 Kim ..... 399/238
6,249,655 B1 * 6/2001 Back et al. ..... 399/12

FOREIGN PATENT DOCUMENTS

JP 2000-338786 12/2000
JP 2001-305867 11/2001

* cited by examiner

*Primary Examiner*—Hoang Ngo

(57) ABSTRACT

The present invention provides a toner recycling control system which stably feeds a liquid developer of an appropriate concentration to a liquid developing apparatus employing a high-viscosity liquid developer; appropriately adjusts the concentration of residual developer collected after development and after transfer; and feeds the adjusted developer to the developing apparatus. The toner recycling control system collects a post-development residual developer from a developer-bearing body and a post-transfer residual developer from an image-bearing body; performs developer concentration adjustment to yield an adjusted developer; and feeds the adjusted developer back to the developer-bearing body. Thus, the toner recycling control system includes a concentration adjustment tank which stores the collected developer and is replenished with a concentrated developer and carrier liquid for developer concentration adjustment; and a buffer tank which receives and stores a liquid developer which has undergone concentration adjustment in the concentration adjustment tank. Once adjusted to an appropriate concentration, the liquid developer is fed to the developer-bearing body from the buffer tank.

39 Claims, 6 Drawing Sheets

[Matrix of Liquid Level Variations and Pump Operation Conditions]

| | | Buffer Tank Liquid Level Sensor | | | Adjustment Tank Liquid Level sensor | | |
|---|---|---|---|---|---|---|---|
| | | Rise | Drop | Unchanged | Rise | Drop | Unchanged |
| Pump2 | Running | | Abnormal if Pump1 in Halt | Abnormal if Pump1 in Halt | Abnormal | | Abnormal |
| | Inactive | Abnormal if Pump1 in Halt | Abnormal if Pump1 in Halt | | | | |

Sensor Configuration

Sensor Configuration

TONER RECYCLE CONTROL SYSTEM OF ELECTROPHOTOGRAPHING DEVICE USING VISCOUS LIQUID DEVELOPING SOLUTION

TECHNICAL FIELD

The present invention relates to a toner recycling control system of an electrophotographic apparatus which collects residual developer remaining after development and after transfer, adjusts the concentration of the collected developer, and feeds the concentration-adjusted developer back to a regular process.

BACKGROUND ART

A liquid-development electrophotographic apparatus uses, as developer, toner liquid which is formed through dispersion of toner particles in carrier liquid. The developer undergoes concentration adjustment beforehand so as to be suitable for use in development, and is subsequently fed to a development section. Development involves transfer of a portion of toner particles and carrier liquid to an image-bearing body (a photosensitive drum), and residual developer is collected from the development section. The developer collected from the development section shows a change in concentration attributable to loss of transferred toner particles (and a portion of carrier), the amount of the loss depending on the ratio between an image area and a non-image area on a print surface. That is, the developer collected at this point of time is not suitable for use in development and thus cannot be reused as is.

The collected developer may be completely disposed of. However, desirably, in order to recycle developer in view of cost and environmental concerns, the developer collected within the apparatus undergoes concentration adjustment and is fed back to the development section.

In a conventional electrophotographic apparatus using a low-viscosity liquid developer, a low-concentration, low-viscosity liquid developer is excessively fed to a latent area on an image-bearing body to thereby form an image. At this time, excess liquid developer is collected and fed back to a developer-bearing body (a developing roller). Repetitive, circulative feed and collection of liquid developer involves consumption of solid matter contained in the liquid developer, resulting in a failure to provide required image density. Therefore, the concentration of the liquid developer is adjusted to a predetermined level through replenishment with concentrated liquid developer, and the thus-adjusted developer is fed to the developer-bearing body.

As mentioned above, according to conventional practice, a low-viscosity liquid developer is excessively fed to a latent area. Thus, the concentration of the fed liquid developer may vary within a certain tolerance. However, since a low-viscosity liquid developer is a volatile liquid, volatilized liquid must be collected within the apparatus, leading to an increase in the size of the apparatus.

By contrast, in a liquid developing apparatus that uses a nonvolatile, high-concentration, high-viscosity liquid developer, the liquid developer is applied, in the form of a thin layer, to a developer-bearing body in an amount suited for obtaining a required image density. The thus-applied liquid developer is fed to a latent area on an image-bearing body. In this case, since the liquid developer is circulated within the developing apparatus, and no volatile liquid is involved, a large-scale liquid collection apparatus is not required.

FIG. 11 is a view showing the configuration of a conventional toner recycling system (refer to Japanese Patent Application Laid-Open (kokai) No. 2001-305867) for recycling a developer (liquid toner) by the steps of collecting the developer remaining after use, measuring the concentration of the collected developer, and adjusting the concentration. A developer fountain collects not only the developer collected from a developing roller, but also carrier liquid, prewetting liquid, or the like collected from a photosensitive drum or an intermediate transfer body. On the basis of concentration measured by means of a concentration measuring unit, a concentration control unit causes the developer fountain to be replenished with carrier liquid and/or high-density developer so as to adjust the concentration of developer contained in the developer fountain to a predetermined level. Once adjusted to a predetermined concentration, the developer is fed in a usual manner to the photosensitive drum via an applicator and the developing roller.

The toner recycling system of the liquid developing apparatus can form, on the developing roller, a thin layer of liquid developer of an appropriate concentration and an appropriate amount. However, in view of the liquid developer being nonvolatile and highly viscous, desirably, a liquid developer having a more stable concentration is quickly formed and fed to the developing roller.

In the case of a conventional low-viscosity liquid developer, required solid content is relatively low. Thus, the low-viscosity liquid developer can be readily transferred by means of a pump. Also, the flow rate can be controlled by use of a flowmeter or the like installed in a transfer line. Further, concentration can be readily and efficiently controlled by, for example, the following method: the liquid developer passing through a slit is measured for light transmission density, and the measured transmission density is used to control the concentration. By contrast, a high-viscosity liquid developer involves difficulty in using a flowmeter, for the following reason. When the high-viscosity liquid developer is left stagnant for a long time in a pipe while in, for example, a nonpowered state, toner particles firmly adhere to the walls of the pipe and flowmeter. Further, particular technical devices must be adopted for concentration control.

In detecting the concentration of a high-concentration liquid developer by use of an optical sensor, a thick layer of the developer renders the optical sensor unusable. Specifically, in the case of a transmission-type sensor, the thick layer completely blocks off light. In the case of a reflection-type sensor, the thick layer causes saturation of reflected light. Thus, the thick layer prevents the optical sensor from detecting a high developer concentration that is required for development. In order to detect the concentration of the high-viscosity, high-concentration liquid developer, the liquid developer must be passed through a narrow gap so as to form a sufficiently thin liquid toner layer (a sufficiently thin developer layer) for measurement of concentration. Also, the high-viscosity developer adhering to a detection section must be mechanically removed. Similarly, when the concentration of the developer is to be determined from current that flows between electrodes, the developer must be passed through a narrow gap between the electrodes, and toner particles adhering to the electrodes must be continually wiped off.

DISCLOSURE OF THE INVENTION

An object of the present invention is to provide a toner recycling control system for a liquid developing apparatus that forms a thin developer layer on a developer-bearing body by use of a high-viscosity liquid developer, which system stably feeds the liquid developer of an appropriate concentration to the liquid developing apparatus, appropriately adjusts the concentration of the residual developer collected after development and after transfer, and feeds the adjusted developer to the developing apparatus.

Another object of the present invention is to quickly form a recycled developer—which is fed to the developing apparatus—from collected residual developer while accurately imparting a required concentration to the recycled developer.

A further object of the present invention is to stably measure the concentration of solid particles contained in collected developer (liquid toner) and enable checking for liquid toner deterioration.

The toner recycling control system of an electrophotographic apparatus of the present invention collects a post-development residual developer from a developer-bearing body of a developing unit—which performs development through formation of a thin layer of high-viscosity liquid developer—and a post-transfer residual developer from an image-bearing body; performs developer concentration adjustment to yield an adjusted developer; and feeds the adjusted developer back to the developer-bearing body. Thus, the toner recycling control system includes a concentration adjustment tank which stores a collected developer and is replenished with a concentrated developer and carrier liquid for developer concentration adjustment; and a buffer tank which receives and stores a liquid developer which has undergone concentration adjustment in the concentration adjustment tank. Once adjusted to an appropriate concentration, the liquid developer is fed to the developer-bearing body from the buffer tank.

A key to the toner recycling control system is to quickly and accurately attain a target developer concentration. To achieve the end, the present invention controls a collection pump, a feed pump, and a reflection-type concentration sensor. According to the present invention, a post-use liquid developer is collected to the concentration adjustment tank from the electrophotographic apparatus, which performs development by use of a high-viscosity liquid developer; and a high-concentration developer or carrier liquid is fed to the concentration adjustment tank in accordance with the detected concentration of the collected liquid developer to thereby adjust the developer to a predetermined concentration for recycling. The feed of a high-concentration developer or carrier liquid is controlled in the following manner: the amount of feed per unit time is varied according to the difference between a concentration sensor output and a target concentration.

The present invention includes an applicator roller for applying to a developing roller a liquid toner received from the buffer tank, so as to form a thin layer of liquid toner on the developing roller; a leveling blade for leveling the thin layer of liquid toner formed on the developing roller and for applying bias to the developing roller; an optical sensor for detecting the transmission density or reflection density of the thin layer of liquid toner after the thin layer of liquid toner is leveled by means of the leveling blade; and a detector for detecting current that flows through the leveling blade. The concentration and fatigue of the liquid toner are determined on the basis of a detection value of the optical sensor and current flowing through the leveling blade.

BEST MODE FOR CARRYING OUT THE INVENTION

Figures 1, 2:
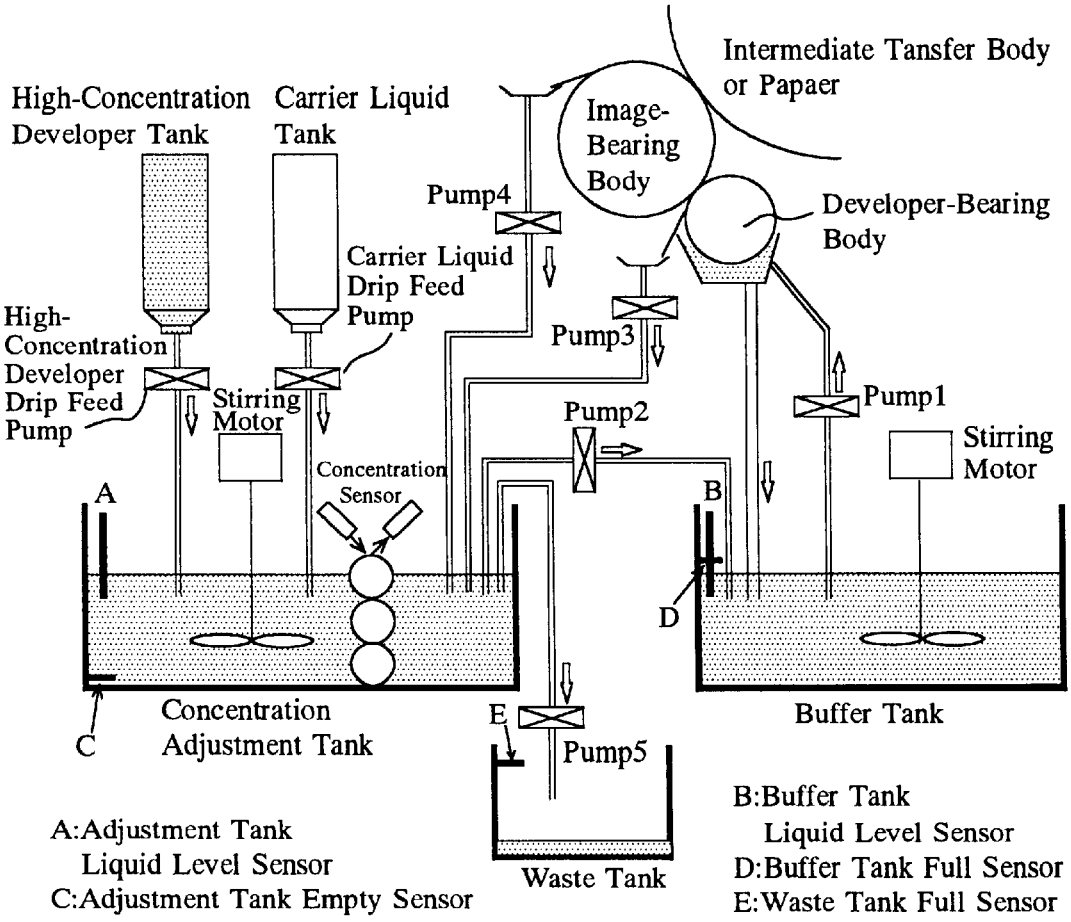
FIG. 1 is a view showing the schematic configuration of a toner recycling apparatus to which the present invention is applicable.
FIG. 2 is a chart showing an example matrix of liquid level variations and pump operation conditions.

An embodiment of the present invention will next be described in detail. FIG. 1 shows the schematic configuration of a toner recycling apparatus to which the present invention is applicable. An electrophotographic apparatus that uses a high-viscosity liquid developer usually includes, as main component members, an image-bearing body (a photosensitive body), developing units corresponding to colors and including respective developer-bearing bodies, and an intermediate transfer body. The image-bearing body includes a charger (not shown) for electrostatically charging the image-bearing body at a predetermined potential, and an exposure unit (not shown) for exposing the electrostatically charged image-bearing body to light to thereby form an electrostatic latent image on the image-bearing body.

The developer-bearing bodies (developing rollers) are usually provided in correspondence with yellow, magenta, cyan, and black. By use of a liquid developer having a toner viscosity of 400 mPa.S to 4000 mPa.S and a carrier viscosity of 2.5 cSt to 1000 cSt, preferably 20 cSt to 200 cSt, a liquid toner layer having a thickness of 5 $\mu$m to 20 $\mu$m is formed on each of the developer-bearing bodies. The developer-bearing bodies supply positively (or negatively) charged toner particles to the image-bearing body according to respective electric fields established between the developer-bearing bodies and the image-bearing body, whereby the toner particles adhere to exposed portions (or unexposed portions) of the image-bearing body, which is electrostatically charged at a predetermined potential.

The intermediate transfer body has a toner image transferred thereto from the image-bearing body according to an electric field established between the intermediate transfer body and the image-bearing body. Subsequently, the intermediate transfer body transfers the toner image to a printing medium, and the transferred toner image is fixed on the printing medium. Alternatively, in the case of monochromatic printing, a toner image may be transferred to and fixed on the printing medium directly from the image-bearing body without use of the intermediate transfer body.

In such a liquid developing apparatus that uses a high-viscosity, high-concentration liquid developer, the density of an image developed on the image-bearing body depends on the solid content of the liquid developer on the developer-bearing body. Therefore, the developing apparatus must maintain the liquid developer at a constant solid concentration. When the concentration of developer suitable for printing is represented by, for example, a solid content of 12.5%, the developer concentration must be controlled at a tolerance of ±0.5%; otherwise, required good printing quality is not reliably obtained.

When a developer that has been adjusted to the optimum concentration is fed to a development section, solid matter (toner particles) contained in the developer participates in development according to the ratio between a development area and a nondevelopment area of an electrostatic latent image, which depends on the contents for printing. Also, contact between the development section and the image-bearing body results ins removal of carrier liquid by a certain percentage. Thus, after the contact, the developer remaining on the development section differs in concentration from the initial developer which has been adjusted to the optimum concentration for printing. In order to reuse, for printing, the developer which has changed in concentration, there must be prepared a process which restores the developer to a predetermined concentration.

In the illustrated toner recycling apparatus, a post-use residual developer is collected to a concentration adjustment tank. Specifically, a post-development residual developer from the developer-bearing body is collected to the concentration adjustment tank via a pump 3, while a residual developer from the image-bearing body is collected to the concentration adjustment tank via a pump 4. The liquid developer collected in the concentration adjustment tank is adjusted to a predetermined developer concentration of, for example, 5% to 30% by means of dripping of high-concentration developer or carrier liquid according to the output of a concentration sensor, and stirring of the developer contained in the concentration adjustment tank.

Adjustment to a predetermined concentration is performed in the following manner. A concentrated developer having a concentration higher than a predetermined developer concentration; for example, a concentrated developer having a concentration of 40%, is fed to the concentration adjustment tank from a high-concentration developer tank that stores the concentrated developer, via a high-concentration developer drip feed pump. Alternatively, in order to dilute the developer having a high concentration to the predetermined concentration, carrier liquid is fed to the concentration adjustment tank from a carrier liquid tank that stores the carrier liquid, via a carrier liquid drip feed pump. The concentration adjustment tank has a stirrer connected to a stirring motor in order to stir the developer contained in the concentration adjustment tank for attaining the predetermined developer concentration.

In the case of a multicolor printing apparatus, a toner recycling apparatus may be configured in the following manner. The toner recycling apparatus has concentrated-developer containers corresponding to the colors and a common carrier liquid container. Carrier liquid is fed from the common carrier liquid container to concentration adjustment tanks corresponding to the colors. Thus, the toner recycling apparatus can be configured so as to be compact and installed in a small area.

When the developer in the concentration adjustment tank is to undergo concentration adjustment, if the concentration adjustment tank is judged to be full, the concentration adjustment is not performed, but a pump 5 is operated so as to discharge the developer to a waste tank until the developer level of the concentration adjustment tank drops so as to allow concentration adjustment. In this case, if printing is in process of way, the developer collected from the developer-bearing body and the image-bearing body is dripping into the concentration adjustment tank. Thus, the developer must be discharged at a rate higher than the dripping rate. Therefore, the discharge rate of the waste pump is controlled such that a liquid level sensor indicates that the liquid level is dropping.

A train of rollers are used as means for forming a developer layer that is used to detect developer concentration. The rollers draw the developer from the concentration adjustment tank. In the course of transfer from one roller to another roller, the developer is spread thinner, so that a uniform, thin layer of developer is formed on the last-stage roller. In order to stabilize the layer thickness, a patterned roller may be used as means for regulating the amount of applied developer. The patterned roller is a well known roller and has fine grooves (pattern) formed on the surface thereof in such a manner as to extend in intersecting directions, whereby a constant amount of developer is conveyed by use of the grooves.

In determination of concentration, light that is reflected from the last-stage roller through a thin layer formed on the roller is measured by use of a reflection-type concentration meter. A liquid developer to be used has a concentration of 5% to 30%, preferably 10% to 20%. Thus, when an optical sensor is used to detect developer concentration by use of reflected light, an excessively thick layer of developer causes saturation of sensor output, resulting in a failure to detect the developer concentration. In order to enable an optical sensor to detect developer concentration, a thin developer layer is formed in such a manner as to have a thickness of 5 $\mu$m to 30 $\mu$m, preferably 10 $\mu$m to 20 $\mu$m. Subsequently, the reflection density of the thin developer layer is measured, and then developer concentration is adjusted.

In order to maintain the developer contained in the concentration adjustment tank at a constant concentration, control is performed in the following manner. When an output from the reflection-type concentration meter falls within a certain allowable range that is determined with respect to an output corresponding to the optimum concentration, no action is performed. When the concentration is higher than the upper limit (e.g., 13%) of the allowable range of concentration, carrier liquid is dripped into the concentration adjustment tank. When the concentration is lower than the lower limit (e.g., 12%) of the allowable range of concentration, a developer having a high concentration (e.g., 25%) which is higher than the optimum concentration for printing is dripped into the concentration adjustment tank.

A developer which has undergone concentration adjustment in the concentration adjustment tank is sent to a buffer tank by means of a pump 2. Since the buffer tank has a sufficiently large capacity, a developer having a concentration suitable for printing can be stably fed even in continuous printing. A pump 1 is used to feed developer from the buffer tank to the developer-bearing body. When concentration adjustment is performed in the concentration adjustment tank; i.e., when the high-concentration developer drip feed pump or the carrier liquid drip feed pump is operating, the pump 2 is deactivated. Since the developer contained in the buffer tank is maintained at a constant concentration at all times, the developer can be fed to the developer-bearing body from the buffer tank, regardless of whether concentration adjustment is performed in the concentration adjustment tank.

The developer which is fed to a developing unit having the developer-bearing body enters a developer fountain provided within the developing unit. The developer is drawn by means of a roller (not shown) and is then applied to the developer-bearing body at a predetermined thickness. Excess developer in formation of the thin layer is returned to the buffer tank through the developer fountain. Since the concentration of the excess developer is equal to that of the fed developer, no concentration adjustment is required. Therefore, the excess developer is returned directly to the buffer tank, not to the concentration adjustment tank, thereby avoiding wasteful work.

In order to prevent firm adhesion of toner, the developer is circulated between the developer-bearing body and the buffer tank. The diameter of a return flow path for returning the developer from the developer-bearing body to the buffer tank is rendered greater than that of a feed flow path for feeding the developer from the buffer tank to the developer-bearing body. Thus, the developer can be smoothly circulated merely by means of the pump 1 installed in the feed flow path.

A thin developer layer formed on the developer-bearing body has a thickness of about 5 $\mu$m to 20 $\mu$m. All solid matter moves to an image area on the image-bearing body from a corresponding portion of the thin developer layer, thereby contributing to development of an image. The developer present at a portion of the thin developer layer which corresponds to a non-image area is collected from the developer-bearing body in a collecting section and is then returned to the toner recycling apparatus. Further, the developer which has been returned to the toner recycling apparatus is adjusted to a predetermined concentration in the concentration adjustment tank. The thus-adjusted developer is sent to the buffer tank and fed back to the developer-bearing body. A post-transfer residual developer collected from the image-bearing body is mostly composed of carrier liquid and contains little solid matter. Further, the post-transfer residual developer may contain foreign matter such as paper dust. Therefore, solid matter may be separated from the post-transfer residual developer so as to return only carrier liquid to the concentration adjustment tank.

A liquid level sensor B and a full sensor D are provided in the buffer tank. In the initial stage of apparatus operation, a process of forming a developer having a concentration suitable for printing is performed until the buffer tank becomes full. In the course of the process, a value that the liquid level sensor B indicates when the buffer tank is full is stored. The liquid level sensor B is adapted to indicate that the liquid level is rising or dropping. Through combined use of the liquid level sensor B and the full sensor D, whether the buffer tank is empty can be judged from a change in liquid level from a state in which the buffer tank is full, thereby eliminating the need to employ an empty sensor.

A liquid level sensor A and an empty sensor C are provided in the concentration adjustment tank. Since the toner recycling apparatus is shipped while the concentration adjustment tank is empty, a value that the liquid level sensor A indicates before the concentration adjustment tank is charged with high-concentration developer and carrier liquid is stored as an empty indication value. Since whether the concentration adjustment tank is full can be judged from a change in liquid level from the empty indication value of the liquid level sensor A, a full sensor is omitted.

When the concentration adjustment tank is judged full, and also the developer concentration of the concentration adjustment tank is judged unsuitable for printing, a predetermined amount of developer is discharged from the concentration adjustment tank in order to perform concentration adjustment. At this time, the developer must be discharged at a rate greater than a rate of collection of developer from the developing unit and the image-bearing body which would otherwise cause an increase in liquid level. Therefore, the output of the waste pump 5 is varied such that the liquid level sensor indicates that the liquid level is dropping.

Means for judging the operation condition of the pumps is provided so as to detect whether each of the pumps is running when so instructed from a control unit. For example, an encoder plate is coaxially mounted on a pump shaft so as to detect clock pulses by use of a sensor.

A matrix of liquid level variations and pump operation conditions is prepared and used in monitoring the operation of the toner recycling apparatus for any inconsistency between pump operation conditions and liquid level variations. An example of the matrix is shown in FIG. 2. As shown in the upper row of the matrix of FIG. 2, when the pump 2 is running, one of the following incidents indicates the occurrence of abnormality: the buffer tank liquid level sensor indicates that the liquid level is dropping or unchanged, while the pump 1 is in halt; and the adjustment tank liquid level sensor indicates that the liquid level is rising or unchanged. As shown in the lower row of the matrix of FIG. 2, when the pump 2 is inactive, the following incident indicates the occurrence of abnormality: the buffer tank liquid level sensor indicates that the liquid level is rising or dropping, while the pump 1 is in halt.

Upon occurrence of any inconsistency as exemplified in FIG. 2, a mechanical engine can promptly stop concentration adjustment and raise the alarm. Since the flow rate in a flow path that connects the developer-bearing body and each of the concentration adjustment tank and the buffer tank can be judged from liquid level variations, feedback control can be performed on pump operation in such a manner as to maintain a constant flow rate in the flow path.

Figure 3:
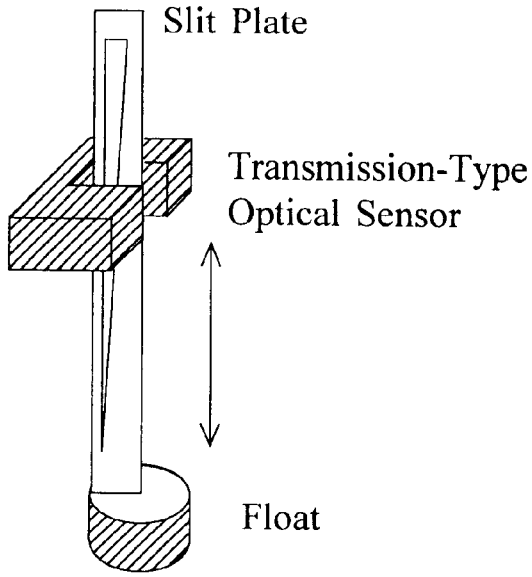
FIG. 3 is a view showing an example liquid sensor configuration.
Figure 4:
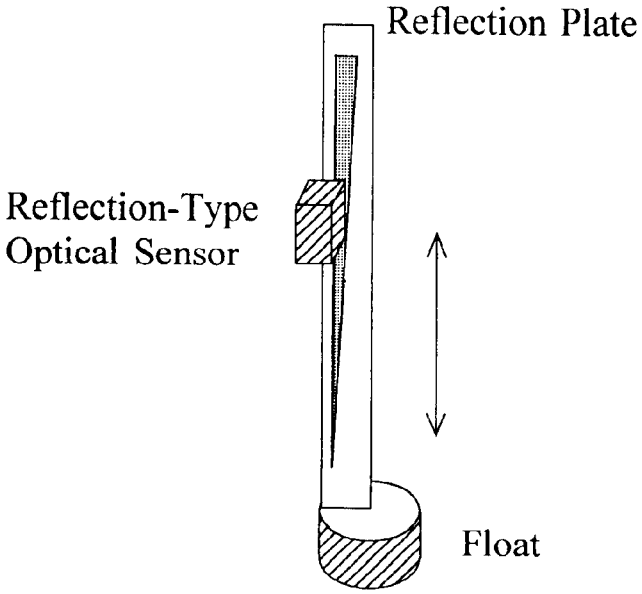
FIG. 4 is a view showing another example liquid sensor configuration.

Liquid level sensors usable herein include those that function in the following manner: a change in resistance of a variable resistor connected to a float is read, the change accompanying a vertical movement of the float; as shown in FIG. 3, a horseshoe-shaped transmission-type optical sensor reads a change in the width of an elongated, triangular slit formed in a slit plate attached to a float, the slit width changing linearly with a vertical movement of the float; and as shown in FIG. 4, a reflection-type optical sensor reads a change in the reflection density of an elongated, triangular pattern formed on a reflection plate attached to the float, the reflection density changing linearly with a vertical movement of the float.

In order to send developer to the developing unit from the buffer tank during printing, the toner recycling apparatus is controlled such that, even on standby for printing, the developer in the buffer tank and the developer in the concentration adjustment tank are stirred, and developer concentration adjustment is performed. The developer concentration adjustment is performed only during printing and at a shallow standby level. A shallow standby level is one of several standby levels and means a level of state at which operation can be resumed relatively easily. Specifically, after the elapse of a certain time following termination of printing, transition to a standby state (a shallow standby level) is performed, and the toner recycling apparatus continues producing a developer having a concentration suitable for printing through concentration adjustment. Further, after the elapse of another certain time, a deep standby level (a sleep mode) is established, and the concentration adjustment is terminated.

The duration of the standby state accompanied by developer concentration adjustment can be determined on the basis of the number of printed sheets in last printing grasped by the mechanical engine, and the volume of developer required to fill the buffer tank that is determined by means of the liquid level sensor. The concentration adjustment operation in the concentration adjustment tank continues for a predetermined time after termination of printing; the concentration adjustment operation is halted when the apparatus enters the sleep mode or electricity saving mode; and a time period before the transition to the sleep mode or electricity saving mode can be varied depending on a volume to fill so as to bring the concentration adjustment tank to the full state as determined by means of the liquid level sensor. Alternatively, the time period before the transition to the sleep mode or electricity saving mode can be determined according to the amount of consumed developer which varies with the number of printed sheets in last printing.

Figure 5:
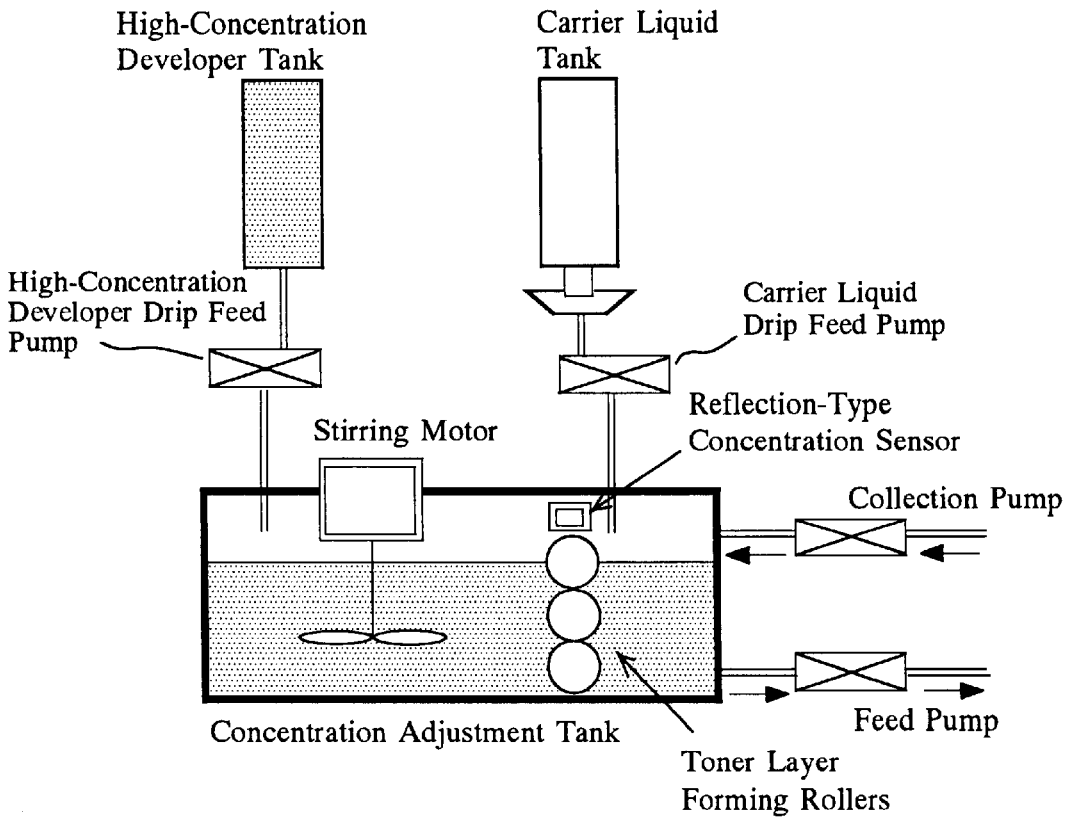
FIG. 5 is a view showing a concentration adjustment tank and relevant portions of the toner recycling apparatus shown in FIG. 1.

Next, feed control of high-concentration developer and carrier liquid in the toner recycling apparatus will be described with reference to FIGS. 5 to 8. FIG. 5 shows the concentration adjustment tank and relevant portions of the toner recycling apparatus shown in FIG. 1. As mentioned previously with respect to FIG. 1, a post-use residual developer from the developer-bearing body and a post-use residual developer from the image-bearing body are collected to the concentration adjustment tank via the respective collection pumps. The liquid developer collected in the concentration adjustment tank undergoes concentration adjustment in the following manner so as to have a predetermined concentration: a high-concentration developer or carrier liquid is dripped into the concentration adjustment tank according to an output from the reflection-type concentration sensor, and the developer contained in the concentration adjustment tank is stirred. The developer which has been adjusted to a predetermined concentration is sent to the buffer tank via a feed pump.

According to an ordinary control method, a concentration signal issued from the reflection-type concentration sensor is compared with a reference voltage by a comparator. On the basis of an output from the comparator, the high-concentration developer drip feed pump of a constant feed rate or the carrier liquid drip feed pump of a constant feed rate is controlled. Such an ordinary control method fails to quickly and accurately perform developer concentration adjustment.

Figure 6:
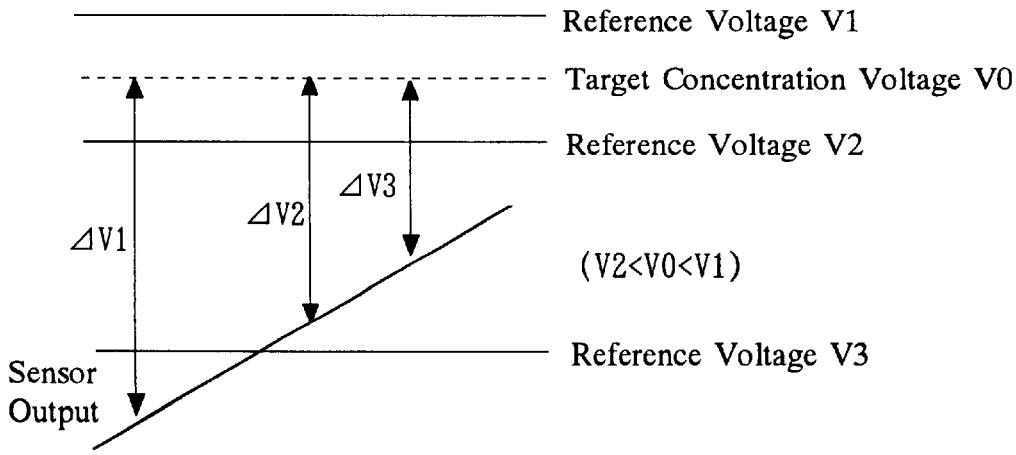
FIG. 6 is a chart showing the relationship among reference voltages for use in concentration control.

FIG. 6 explains variable control in which, on the basis of the voltage difference between an output form the reflection-type concentration sensor and a target concentration voltage V0, the amount of feed per unit time of the high-concentration developer drip feed pump or carrier liquid drip feed pump is varied. Employment of a variable feed rate prevents overshoot of control; allows fine adjustment of pump operation so as to attain a target toner concentration to the greatest possible extent; and allows quick attainment of a target developer concentration even when the current concentration indicated by a sensor is greatly apart from the target concentration.

As shown in FIG. 6, a target concentration voltage V0 is represented with a dotted line; a reference voltage V1 is set higher than the target concentration voltage V0; and a reference voltage V2 is set lower than the target concentration voltage V0 (V2<V0<V1). The V1–V2 range shows an allowable range of developer concentration which does not cause a change in the level of image quality. Further, a reference voltage V3 is set lower than the reference voltage V2. A sensor output, which is a concentration detection signal, is represented with an oblique line.

First, when a sensor output is not greater than the reference voltage V3 (sensor output<reference voltage V3); i.e., when the difference between the sensor output and the target concentration voltage V0 is great as represented with ΔV1 in FIG. 6, the amount of feed per unit time of the high-concentration developer drip feed pump or carrier liquid drip feed pump is maximized. Assuming that low voltage represents low developer concentration, a sensor output not greater than the reference voltage V3 means that the developer concentration is lower than a target concentration. In this case, the pump for feeding the high-concentration developer is operated. FIG. 6 does not show, but there is also set a reference voltage which is higher than the target concentration voltage V0 and corresponds to the reference voltage V3. When a sensor output exceeds this reference voltage, control similar to that described above is carried out. In this case, the pump for feeding carrier liquid (silicone oil), not a high-concentration developer, is operated.

Next, as represented with ΔV2 and ΔV3 in FIG. 6, when the sensor output is in excess of the reference voltage V3 (sensor output>reference voltage V3), the amount of feed per unit time of a pump is varied on the basis of (in proportion to) the voltage difference between the sensor output and the target concentration voltage V0.

Figure 8:
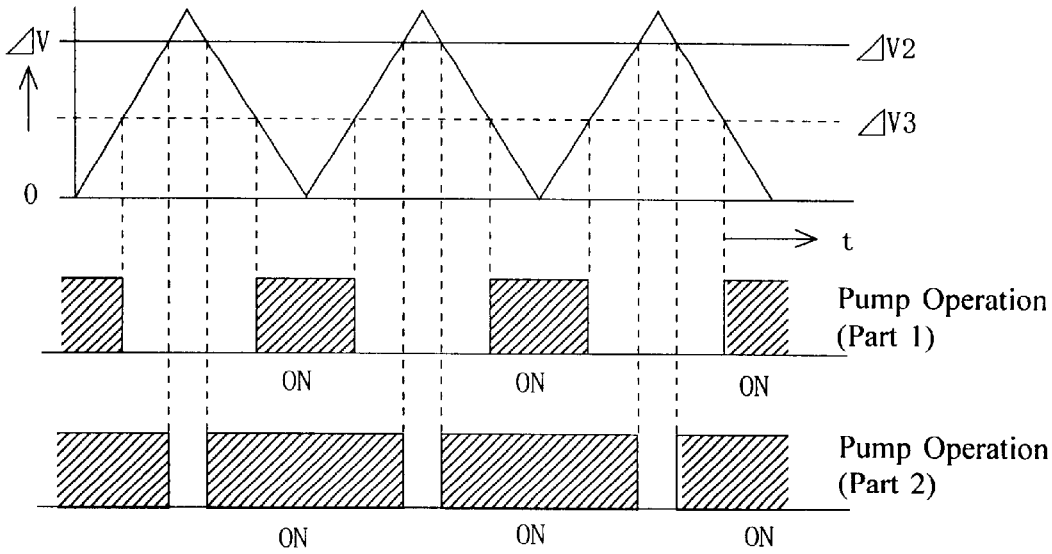
FIG. 8 is a chart explaining control of the amount of feed per unit time of a pump on the basis of voltage differences.

Control to vary the amount of feed per unit time of a pump on the basis of the voltage difference will be further described with reference to FIG. 8. As shown in FIG. 8, this control can be variable duty control in which a voltage difference ΔV between the sensor output and the target concentration voltage V0 is compared with a triangular voltage; while the voltage difference ΔV is in excess of the triangular voltage, the pump is held on; and otherwise, the pump is held off. In FIG. 8, ΔV2 and ΔV3 correspond to the voltage differences shown in FIG. 6.

Figure 7:
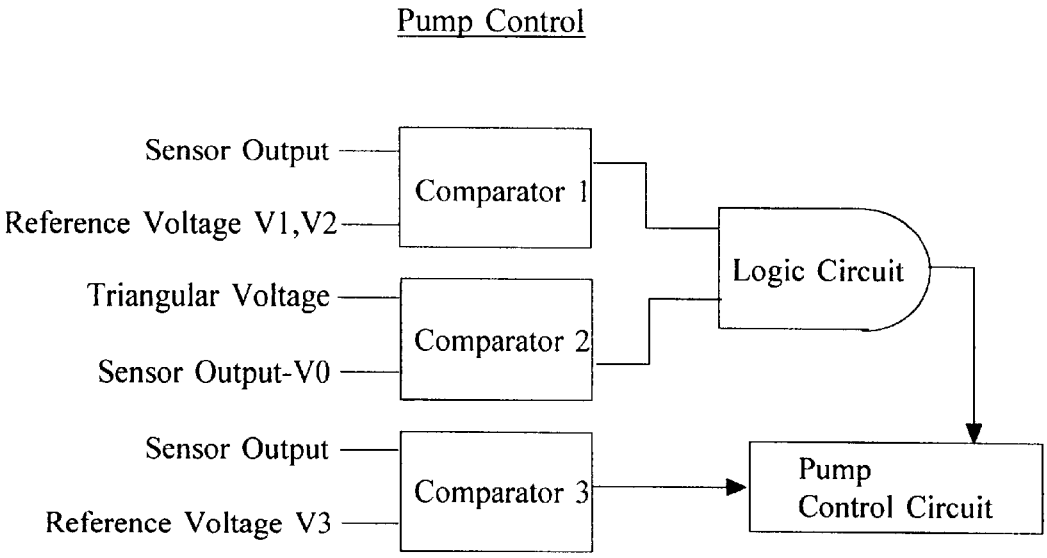
FIG. 7 is a pump control circuit diagram.

The above-described control will further be described with reference to FIG. 7 which shows a pump control diagram. First, a comparator 1 compares the sensor output with the reference voltages V1 and V2 (see FIG. 6). When the sensor output falls within the V1–V2 range, the developer concentration is judged to fall within an allowable range. Thus, the output of a logic circuit is turned off, thereby controlling a pump control circuit so as not to operate a pump. As described above with reference to FIG. 8, a comparator 2 is used to perform the following control: the amount of feed per unit time of a pump is varied on the basis of a voltage difference (variable duty control). A comparator 3 is used to perform the following control: as described previously, the sensor output is compared with the reference voltage V3; and when the sensor output is not greater than the reference voltage V3, the amount of feed per unit time of the high-concentration developer drip feed pump is maximized. As mentioned previously, this control is applied to the case where the developer concentration is lower than the target concentration. In the case where the developer concentration is higher than the target concentration, basically the same control is performed, and description thereof is omitted.

A liquid level sensor may be provided in the concentration adjustment tank adapted to attain the target concentration, so as to feed back the sensed liquid level to the feed rate of a pump. Even though the liquid level of the concentration adjustment tank is low, if the developer concentration of the concentration adjustment tank is near a target concentration, the feed rate of a pump becomes low; as a result, production of a developer having a predetermined concentration consumes much time. In order to avoid this problem, when the liquid level of the concentration adjustment tank is not higher than the reference level, the high-concentration developer and carrier liquid are both fed to the concentration adjustment tank, regardless of sensor output. Subsequently, when the liquid level of the concentration adjustment tank reaches or becomes higher than the reference level, the high-concentration developer drip feed pump or the carrier liquid drip feed pump is controlled on the variable duty basis as described above.

When the high-concentration developer and carrier liquid are both fed to the concentration adjustment tank because of low liquid level, the amount of feed per unit time of carrier liquid is rendered lower than that of the high-concentration developer on the basis of the ratio as calculated by ((target developer concentration)÷(concentration of high-concentration developer)). By so doing, while the developer concentration of the concentration adjustment tank is maintained near the target developer concentration, the liquid level of the concentration adjustment tank can be increased.

If pump operation control on the basis of an output from the concentration sensor is activated immediately after power is turned on, a pump will be operated even in an unstable region in which no stability is established in terms of the thickness of a liquid toner layer that is measured for concentration by the concentration sensor. In order to avoid this problem, pump operation control is started after the thickness of the liquid toner layer becomes constant, thereby avoiding ineffective feed of undiluted toner liquid and silicone oil.

Since the allowable range of developer concentration which does not cause a change in image quality is represented by the reference voltages V1 and V2 (see FIG. 6), a sensor output falling within this V1–V2 range indicates production of a developer having a target concentration. However, a liquid toner involves the following problem stemming from its properties: even though the concentration of developer is constant, a change in temperature of liquid toner is accompanied by a change in viscosity of liquid toner, thereby leading to a change in thickness of a liquid toner layer that is formed by means of liquid toner layer forming rollers. Thus, the sensor output varies in measurement of the same developer concentration; therefore, the V1–V2 range determined so as to produce a developer having a target concentration must be varied accordingly. In order to solve this problem, a reference toner tank which contains a developer having a target concentration is prepared. Even when viscosity changes due to a change in ambient temperature, a relative value between the developer contained in the concentration adjustment tank and the developer contained in the reference toner tank remains unchanged. Thus, the concentration of the reference developer is measured, and then on the basis of the measured concentration of the reference developer, the reference voltages V1 and V2 are determined in such a manner as not to cause a change in image quality. The thus-determined reference voltages are used as threshold values in adjusting the developer concentration of the concentration adjustment tank to a target developer concentration. By so doing, even when the viscosity of liquid toner changes due to a change in ambient temperature, the target developer concentration can be attained.

Alternatively, with regard to a developer having a target concentration, the output voltage of the toner concentration sensor is measured while temperature is varied, to thereby create beforehand a table showing the relationship between temperature and the output voltage of the toner concentration sensor. The table is stored in a memory of a control unit. In adjustment of developer concentration, an ambient temperature is measured by use of a temperature sensor. On the basis of the measured temperature and with reference to the table, an output voltage of the toner concentration sensor at the temperature is obtained. The thus-obtained output voltage can be fed back to a process of determining the threshold values (reference voltages V1 and V2).

Figure 9:
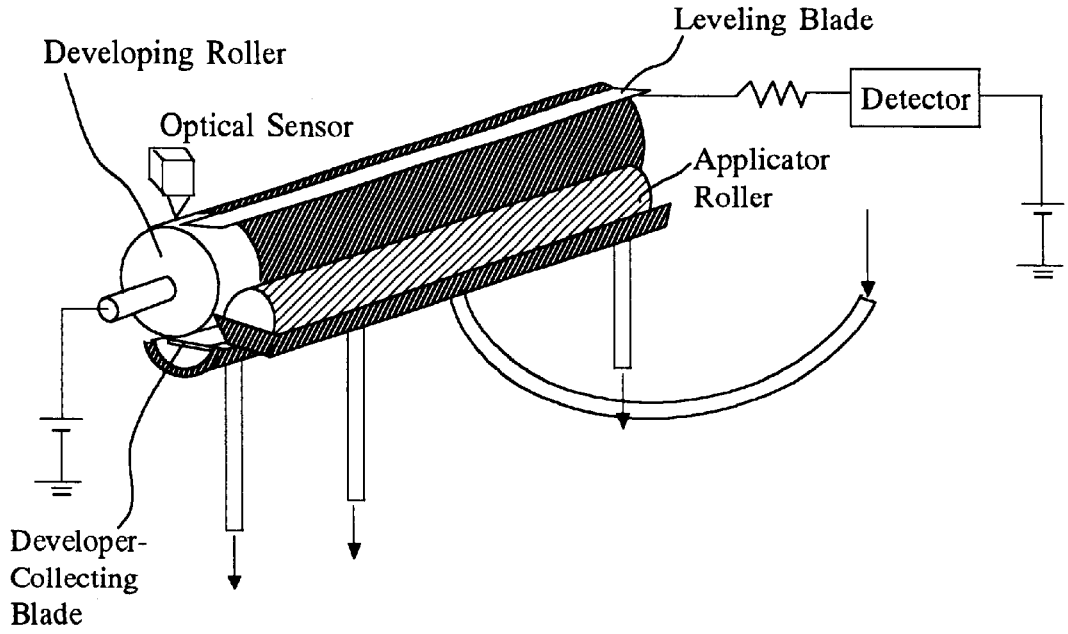
FIG. 9 is a perspective view showing an example concept of detecting developer concentration on a developing roller.
Figure 10:
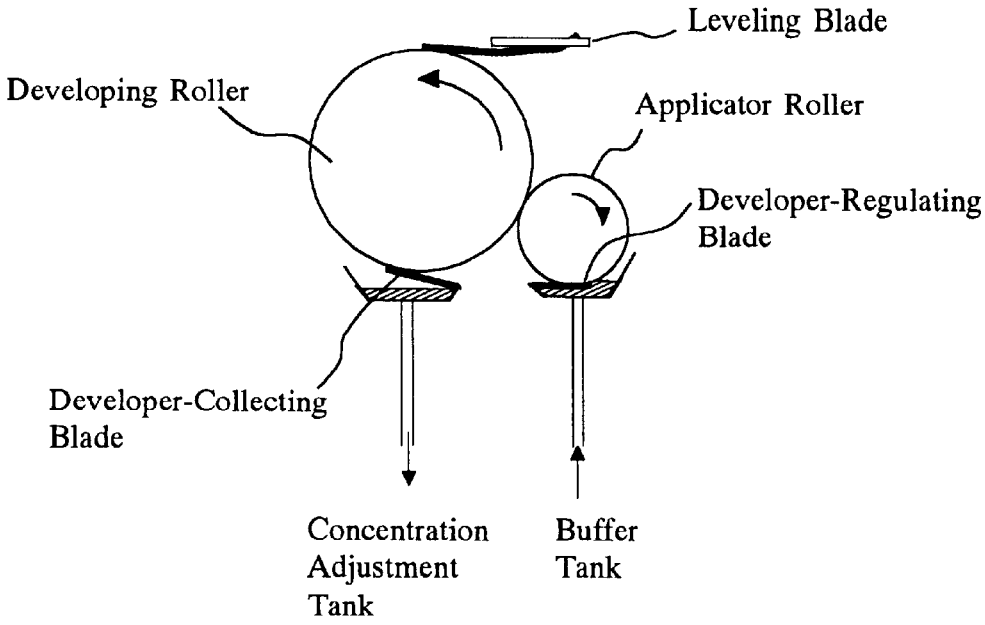
FIG. 10 is a view showing an example arrangement of the developing roller and relevant component members shown in FIG. 9.
Figure 11:
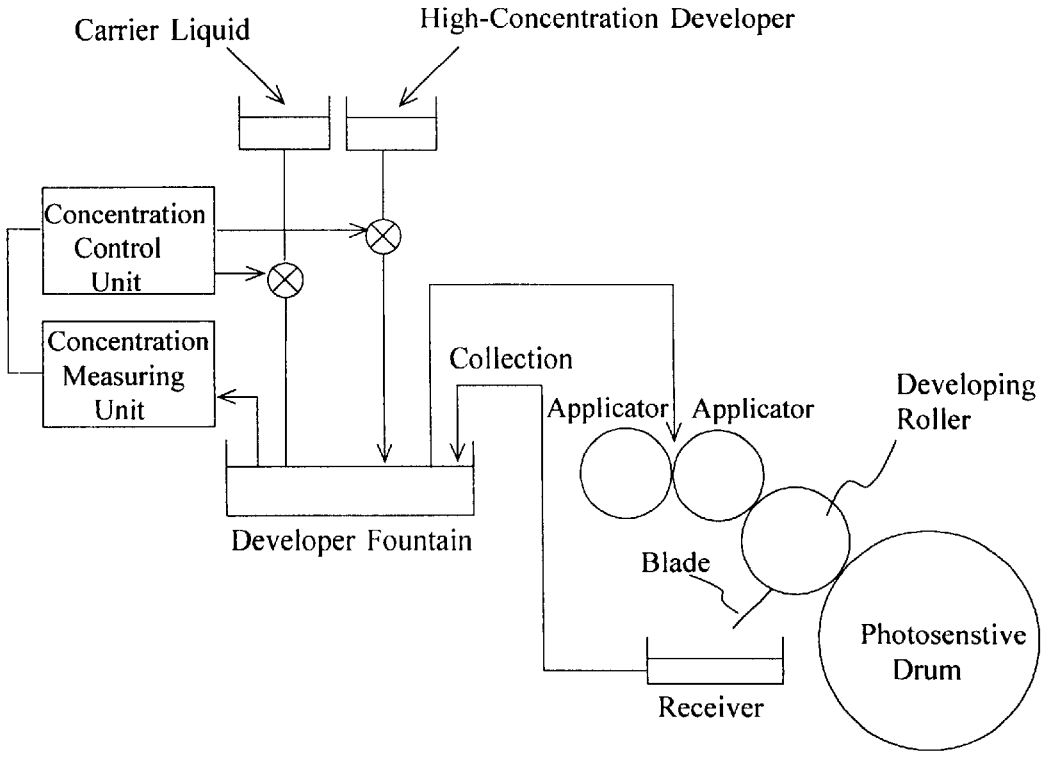
Fig. 11 Prior Art
FIG. 11 is a view showing the configuration of a conventional toner recycling system.

FIGS. 9 and 10 exemplify the concept of detection of developer concentration on the developing roller. FIG. 9 is a perspective view showing the developing roller and relevant component members, and FIG. 10 shows the relative arrangement of the component members. Since a liquid toner is used as a liquid developer, the liquid developer is applied to the developing roller in the form of a thin layer having a thickness of 1 $\mu$m to 50 $\mu$m. The thin layer of liquid developer is brought to a development gap section, which is a contact section between the developing roller and an unillustrated photosensitive drum. The liquid developer that remains on the developing roller after passing the development gap section is scraped off by means of a developer-collecting blade and then returned to the concentration adjustment tank. The concentration of the collected developer differs from a predetermined concentration since solid particles and carrier liquid have transferred onto the photosensitive drum at certain respective percentages, depending on the ratio between an image area and a non-image area. As mentioned previously, the collected developer is mixed with the liquid developer that remains in the concentration adjustment tank while the tank is replenished with a high-concentration developer and carrier liquid, whereby a liquid toner having a predetermined concentration is produced.

The liquid toner having a predetermined concentration is sent to an applicator roller from the buffer tank by use of a pump or the like. For example, as shown in FIG. 9, the liquid toner is sent to a central portion of the applicator roller and returned to the buffer tank from opposite end portions of the applicator roller, thereby being circulated. Thus, a constant amount of liquid toner can be fed to the applicator roller at a constant pressure. The applicator roller spread the received liquid toner thin and transfers the liquid toner to the developing roller, whereby development is performed.

The high-viscosity, high-concentration liquid toner is collected as described above. Further, the exemplified configuration provides a simply configured liquid toner concentration detection system that can optically and electrically detect the concentration of developer on the developing roller to thereby check developer concentration and electrical fatigue of developer.

As illustrated, a leveling blade is provided on the developing roller. The leveling blade is intended to level a thin liquid toner layer that is formed on the developing roller by means of the applicator roller. The leveling blade allows application of bias thereto. The leveling blade is electrically conductive and can be formed from, for example, electrically conductive rubber having a volume resistivity of $10^3$ Ω to $10^8$ Ω. Such an electrically conductive blade has appropriate elasticity and can be brought into contact with the developing roller such that an edge surface thereof is in contact with the developing roller while being postured along the rotational direction of the developing roller as shown in FIG. 10, at such a pressure as to allow the passing of a liquid toner having, for example, a predetermined viscosity of 50 cSt to 5000 cSt in a predetermined amount of, for example, 1 $\mu$m to 50 $\mu$m.

Voltage is applied to the leveling blade. For example, voltage of the same polarity as toner polarity; specifically, a bias voltage of +1300 V, can be applied. The bias voltage causes toner particles to move toward the surface of the developing roller; i.e., to move to a lower region of the liquid toner layer. As a result, carrier liquid moves to a surface region of the liquid toner layer. In other words, the surface region of the liquid toner layer on the developing roller is in a state such that toner particles are sparsely scattered.

When the liquid toner layer on the developing roller comes into contact with a photosensitive body to thereby perform development, a region of the liquid toner layer which comes in direct contact with the photosensitive body is a surface region of the liquid toner layer on the developing roller; i.e., carrier liquid in which toner particles are sparsely scattered. The carrier liquid functions similarly as does an electrically insulative liquid (prewetting liquid) that can be applied to the photosensitive body before development is performed, in order to suppress fogging at a non-image area, which would otherwise occur as a result of viscous adhesion of toner fluid.

According to the illustrated configuration, an optical sensor for detecting the transmission density or reflection density of the thin liquid layer is provided above the developing roller downstream of a position where the liquid toner is uniformly applied to the developing roller in the form of a thin layer and upstream of a position where the developing roller abuts the photosensitive body; and a detector is provided for detecting current flowing through the leveling blade.

Developer concentration is adjusted on the basis of a detection value of the optical sensor and a detected blade current. When the detection value of the optical sensor and the detected blade current are greater than respectively predetermined values, the carrier liquid is fed to the concentration adjustment tank. When the detection value of the optical sensor and the detected blade current are less than the respectively predetermined values, the high-concentration developer is fed to the concentration adjustment tank. Control is performed in such a manner as to bring the detected values to the respectively predetermined values.

When the difference between the detection value of the optical sensor and the detected blade current is greater than a predetermined value, the developer is judged to be fatigued, and the feed of the carrier liquid and the high-concentration developer is stopped. Developer fatigue is accompanied by variation of bias current even when bias voltage is constant for a predetermined developer concentration which is determined from the detection value of the optical sensor. When the developer is fatigued, the entire developer must be replaced with new developer instead of being adjusted through replenishment with new developer. Developer fatigue means that the developing properties of the initial liquid toner cannot be maintained any more due to, for example, change in electrostatic properties.

When the difference between the detection value of the optical sensor and the detected current flowing to the leveling blade falls within the predetermined range; i.e., when developer fatigue is within an acceptable range, image density can be adjusted to that to be exhibited by use of the initial liquid toner, through appropriate modification of development bias.

A reflection-type optical sensor may be provided outside an image area while a corresponding portion of the developing roller is in white or a similar color so as to provide a reference for concentration. Usually, the developing roller is in a blackish, little reflective color since it must be electrically conductive. However, a reflective color is imparted to a light reflection area of the developing roller, so that light emitted from the optical sensor is reflected from the surface of the developing roller through the liquid toner layer, and the reflected light is detected by means of the optical sensor.

When a transmission-type optical sensor is used, a light source for measurement use is provided within the developing roller; and light emitted from the light source passes through the developing roller and the liquid toner layer and is then detected by means of the optical sensor.

A patterned roller may be used as an applicator roller for forming a liquid toner layer on the developing roller. The patterned roller (e.g., an anilox roller produced by Asahi Roll Co., Ltd.) has a groove pattern formed thereon. Examples of such a groove pattern include the following: 100 to 350 line grooves per inch are formed obliquely with respect to the circumferential direction; and in addition to the line grooves, line grooves that intersect the line grooves are formed to thereby form a lattice pattern. By utilization of such grooves, the patterned roller can feed a constant amount of developer which is determined only by the number and size (cross-sectional area) of grooves. Thus, use of a patterned roller stabilizes the feed rate of developer and the thickness of a liquid toner layer which is formed on a roller and whose concentration is to be measured.

A heater may be provided in the buffer tank so as to maintain a contained liquid toner at a constant temperature. As temperature rises, the viscosity of liquid toner drops; by contrast, as temperature drops, the viscosity rises. Therefore, desirably, a liquid toner is maintained at a constant temperature so as to avoid an excessive change of viscosity of the liquid toner.

INDUSTRIAL APPLICABILITY

The present invention employs the buffer tank in addition to the concentration adjustment tank. The buffer tank contains only a developer that has been adjusted to the optimum concentration for printing, whereby the developer having the optimum concentration can be fed at all times even during continuous printing.

The present invention can provide a toner recycling control system that is simply configured in such a manner as not to require installation of a flow rate sensor or the like in, for example, a line extending between tanks or a line extending between the developer-bearing body and a tank, through employment of a devised method for detecting a liquid level and a change in liquid level of each tank.

The present invention provides a relatively simple configuration for intra-apparatus recycling of high-viscosity liquid developer and allows a developer having a concentration suitable for printing to be fed at all times.

What is claimed is:

1. A toner recycling control system of an electrophotographic apparatus which collects a post-development residual developer from a developer-bearing body—which performs development through formation of a thin layer of high-viscosity liquid developer—and a post-transfer residual developer from an image-bearing body; performs developer concentration adjustment to yield an adjusted developer; and feeds the adjusted developer back to said developer-bearing body, said system comprising:

a concentration adjustment tank storing a collected developer and being replenished with a concentrated developer and carrier liquid for developer concentration adjustment; and a buffer tank receiving and storing a liquid developer which has undergone concentration adjustment in said concentration adjustment tank;

wherein the liquid developer adjusted to an appropriate concentration is fed from said buffer tank to a developer fountain provided within a developing unit having said developer-bearing body.

2. A toner recycling control system of an electrophotographic apparatus as described in claim 1, further comprising circulation flow paths configured such that excess developer in formation of a layer of the fed liquid developer on said developer-bearing body is returned to said buffer tank; and the post-development residual developer collected from said developer-bearing body after development and the post-transfer residual developer collected from said image-bearing body after transfer are returned to said concentration adjustment tank.

3. A toner recycling control system of an electrophotographic apparatus as described in claim 1, further comprising a thin-layer forming body for forming, on a surface thereof, a thin layer from the liquid developer contained in said concentration adjustment tank, wherein reflection density of the thin layer of developer formed on said thin-layer forming body is detected to thereby detect a concentration of the liquid developer.

4. A toner recycling control system of an electrophotographic apparatus as described in claim 3, wherein said thin-layer forming body comprises pairs of rollers; and developer concentration on a last-stage roller is detected by means of a reflection sensor.

5. A toner recycling control system of an electrophotographic apparatus as described in claim 4, wherein a patterned roller is used as a roller adjacent to said last-stage roller and adapted to feed a developer to said last-stage roller, in order to regulate an amount of developer application.

6. A toner recycling control system of an electrophotographic apparatus as described in claim 3, wherein the thin layer of developer from which reflection density is detected has a thickness of 5 $\mu$m to 30 $\mu$m.

7. A toner recycling control system of an electrophotographic apparatus as described in claim 1, wherein solid matter is separated from the post-transfer residual developer collected from said image-bearing body, and only carrier liquid is returned to said concentration adjustment tank.

8. A toner recycling control system of an electrophotographic apparatus as described in claim 1, wherein a developing unit including said developer-bearing body is provided for each of a plurality of colors to thereby configure a multi-color printing apparatus; a concentrated-developer container is provided for each of the colors, while one common carrier liquid container is provided; and carrier liquid is fed to concentration adjustment tanks corresponding to the colors from said carrier liquid container.

9. A toner recycling control system of an electrophotographic apparatus as described in claim 3, wherein the concentration-adjusted liquid developer has a predetermined concentration ranging from 5% to 30%.

10. A toner recycling control system of an electrophotographic apparatus as described in claim 1, wherein a liquid level sensor is attached to each of said buffer tank and said concentration adjustment tank; a mechanism for judging a pump operation condition is provided; and through monitoring of a matrix of liquid level variations and pump operation conditions, pump operation is monitored for abnormality without need to install a flow rate sensor.

11. A toner recycling control system of an electrophotographic apparatus as described in claim 10, wherein feedback is performed on pump operation on the basis of a change in liquid level that is detected by said liquid level sensor, to thereby maintain pump operation at a constant flow rate.

12. A toner recycling control system of an electrophotographic apparatus as described in claim 10, wherein each of said liquid level sensors is configured in such a manner as to read an output from a variable resistor connected to a float floating on liquid surface, in the course of vertical movement of the float.

13. A toner recycling control system of an electrophotographic apparatus as described in claim 10, wherein each of said liquid level sensors is configured such that a transmission-type optical sensor reads a triangular slit, a width of the slit changing linearly with a vertical movement of a float floating on liquid surface.

14. A toner recycling control system of an electrophotographic apparatus as described in claim 10, wherein each of said liquid level sensors is configured such that a reflection-type optical sensor reads a triangular pattern formed on a reflection plate, a reflection density of the triangular pattern changing linearly with a vertical movement of a float floating on liquid surface.

15. A toner recycling control system of an electrophotographic apparatus as described in claim 10, wherein, in addition to said liquid level sensor, a full sensor for detecting that said buffer tank is full is attached to said buffer tank; and whether said buffer tank is empty is judged from a change in liquid level from a state in which said buffer tank is full.

16. A toner recycling control system of an electrophotographic apparatus as described in claim 15, wherein, when apparatus power is turned on, a developer having a concentration suitable for printing is prepared and fed until said buffer tank becomes full; and a value that said liquid level sensor indicates when said buffer tank is full is retained.

17. A toner recycling control system of an electrophotographic apparatus as described in claim 10, wherein, in addition to said liquid level sensor, an empty sensor is attached to said concentration adjustment tank; and whether said concentration adjustment tank is full is judged from a change in liquid level from a state in which said concentration adjustment tank is empty.

18. A toner recycling control system of an electrophotographic apparatus as described in claim 17, wherein, before start of initial apparatus operation, a value that said liquid level sensor indicates before the high-concentration developer and the carrier liquid begin to be dripped into said concentration adjustment tank is retained.

19. A toner recycling control system of an electrophotographic apparatus as described in claim 17, wherein, when said concentration adjustment tank is judged full, and also the concentration of the developer contained in said concentration adjustment tank is judged unsuitable for printing, the developer is discharged from said concentration adjustment tank.

20. A toner recycling control system of an electrophotographic apparatus as described in claim 19, wherein, in order to discharge the developer at a rate greater than a rate of collection of developer from said developer-bearing body and said image-bearing body which would otherwise cause an increase in liquid level, an output of a waste pump is varied such that said liquid level sensor indicates that the liquid level is dropping.

21. A toner recycling control system of an electrophotographic apparatus as described in claim 10, wherein a concentration adjustment operation in said concentration adjustment tank continues for a predetermined time after termination of printing; the concentration adjustment operation is halted upon entry into apparatus sleep mode or electricity saving mode; and a time period before the transition to the sleep mode or electricity saving mode is varied depending on a volume to fill so as to bring said concentration adjustment tank to a full state as determined by means of said liquid level sensor.

22. A toner recycling control system of an electrophotographic apparatus as described in claim 10, wherein a concentration adjustment operation in said concentration adjustment tank continues for a predetermined time after termination of printing; the concentration adjustment operation is halted upon entry into apparatus sleep mode or electricity saving mode; and a time period before the transition to the sleep mode or electricity saving mode is varied depending on an amount of consumed developer which varies with the number of printed sheets in last printing.

23. A toner recycling control system of an electrophotographic apparatus as described in claim 2, wherein a diameter of a return flow path for returning the developer from said developer-bearing body to said buffer tank is rendered greater than that of a flow path for feeding the developer from said buffer tank to said developer-bearing body, thereby allowing smooth circulation of the developer without installation of a pump in the return flow path.

24. A toner recycling control system of an electrophotographic apparatus as described in claim 1, wherein feed of the high-concentration developer or carrier liquid is controlled such that an amount of feed per unit time is varied according to a difference between a concentration sensor output and a target concentration.

25. A toner recycling control system of an electrophotographic apparatus as described in claim 24, wherein, while the difference between the concentration sensor output and the target concentration voltage is a predetermined value or greater, the amount of feed per unit time is maximized.

26. A toner recycling control system of an electrophotographic apparatus as described in claim 24, wherein a liquid level sensor is provided for detecting a liquid level of said concentration adjustment tank; and while a liquid level of said concentration adjustment tank is not higher than a predetermined reference level, the high-concentration developer and carrier liquid are both fed to said concentration adjustment tank, regardless of the concentration sensor output.

27. A toner recycling control system of an electrophotographic apparatus as described in claim 26, wherein, while the liquid level of said concentration adjustment tank is not higher than the predetermined reference level, an amount of feed per unit time of the carrier liquid is rendered lower than that of the high-concentration developer on the basis of a ratio of a target developer concentration to a concentration of the concentrated developer fed to said concentration adjustment tank.

28. A toner recycling control system of an electrophotographic apparatus as described in claim 24, wherein feed control of the concentrated developer or carrier liquid is started after a predetermined time following turning on of apparatus power elapses so as to allow a thickness of a liquid toner layer—which is a detection object of said liquid level sensor—to become constant.

29. A toner recycling control system of an electrophotographic apparatus as described in claim 24, wherein a first concentration reference and a second concentration reference that defines an allowable range of developer concentration are determined such that the target concentration falls therebetween; when the concentration sensor output falls within the allowable range, feed control of the concentrated developer or carrier liquid is stopped; and the first concentration reference and the second concentration reference are varied according to temperature.

30. A toner recycling control system of an electrophotographic apparatus as described in claim 29, where said system further comprises a reference toner tank which contains a developer adjusted to a target concentration; and while a developer concentration detected in said reference toner tank is taken as a target concentration at a temperature as measured at the time of detection, the first concentration reference and the second concentration reference—which define the allowable range of developer concentration—are varied according to the target concentration.

31. A toner recycling control system of an electrophotographic apparatus as described in claim 29, wherein, with regard to a developer having a target concentration, an output of a toner concentration sensor is measured while temperature is varied, to thereby create beforehand a table showing the relationship between temperature and the output of the toner concentration sensor; and in adjustment of developer concentration, on the basis of an ambient temperature measured by use of a temperature sensor and with reference to the table, a target concentration at the measured temperature is obtained, and the first concentration reference and the second concentration reference —which define the allowable range of developer concentration—are varied according to the target concentration.

32. A toner recycling control system of an electrophotographic apparatus as described in claim 1, wherein said developer-bearing body comprises a developing roller;

said system further comprises a leveling blade for leveling a thin layer of liquid toner formed on said developing roller and for applying bias to said developing roller; an optical sensor for detecting transmission density or reflection density of the thin layer of liquid toner after the thin layer of liquid toner is leveled by means of said leveling blade; and a detector for detecting current that flows through said leveling blade; and a concentration and fatigue of the liquid toner are determined on the basis of a detection value of said optical sensor and current flowing through said leveling blade.

33. A toner recycling control system of an electrophotographic apparatus as described in claim 32, further comprising an applicator roller for forming the thin layer of liquid toner on said developing roller, said applicator roller comprising a patterned roller.

34. A toner recycling control system of an electrophotographic apparatus as described in claim 32, wherein a heater is provided in said buffer tank so as to maintain a contained liquid toner at a constant temperature.

35. A toner recycling control system of an electrophotographic apparatus as described in claim 32, wherein, when a detection value of said optical sensor and a detected blade current are greater than respectively predetermined values, the carrier liquid is fed to said concentration adjustment tank so as to adjust developer concentration such that the detection value and the detected blade current are brought to the respectively predetermined values; and when the detection value and the detected blade current are less than the respectively predetermined values, the high-concentration developer is fed to said concentration adjustment tank so as to adjust developer concentration such that the detection value and the detected blade current are brought to the respectively predetermined values.

36. A toner recycling control system of an electrophotographic apparatus as described in claim 35, further comprising a mechanism functioning such that, when a difference between the detection value of said optical sensor and the detected blade current is greater than a predetermined value, the developer is judged to be fatigued, and feed of the carrier liquid and the high-concentration developer is stopped.

37. A toner recycling control system of an electrophotographic apparatus as described in claim 32, wherein, when a concentration as detected on said developing roller by means of said optical sensor and a detected current flowing through said leveling blade are greater than respectively predetermined values, the carrier liquid is fed to said concentration adjustment tank; and when the detected concentration and the detected current are less than the respectively predetermined values, the high-concentration developer is fed to said concentration adjustment tank.

38. A toner recycling control system of an electrophotographic apparatus as described in claim 37, wherein said optical sensor is provided outside an image area while a corresponding portion of said developing roller is in white or a similar color so as to provide a reference for concentration.

39. A toner recycling control system of an electrophotographic apparatus as described in claim 37, wherein, when a difference between the detection value of said optical sensor and the detected current flowing to said leveling blade falls within a predetermined range, image density is adjusted through modification of development bias.

* * * * *

UNITED STATES PATENT AND TRADEMARK OFFICE

CERTIFICATE OF CORRECTION

PATENT NO. : 6,687,477 B2
DATED : February 3, 2004
INVENTOR(S) : Motoharu Ichida et al.

It is certified that error appears in the above-identified patent and that said Letters Patent is hereby corrected as shown below:

Title page,
Item [54], Title, change to -- TONER RECYCLING CONTROL SYSTEM OF ELECTROPHOTOGRAPHIC APPARATUS USING HIGH-VISCOSITY LIQUID DEVELOPER --.
Item [75], Inventors, change "Yoshiaki Kawamoto" to -- Yoshiro Kawamoto --; change "Shigeki Uesugi, Unoke-machi, (JP)" to -- Shigeki Uesugi, Kahoku-gun, (JP) --; change "Tadasuke Yoshida, Uchinada-machi (JP)" to -- Tadasuke Yoshida, Kahoku-gun (JP) --; change "Masanobu Hongo, Unoke-machi (JP)" to -- Masanobu Hongo, Kahoku-gun (JP) --; change "Yasuhiko Kishimoto, Uchinada-machi (JP)" to -- Yasuhiko Kishimoto, Kahoku-gun (JP) --; change "Tatsuo Nozaki, Unoke-machi (JP)" to-- Tatsuo Nozaki, Kahoku-gun (JP) --; and change "Akihiko Inamoto, Uchinada-machi (JP)" to -- Akihiko Inamoto, Kahoku-gun (JP) --.

Signed and Sealed this

Eighteenth Day of May, 2004

JON W. DUDAS
*Acting Director of the United States Patent and Trademark Office*